United States Patent [19]

Van Houten et al.

[11] Patent Number: 5,000,660

[45] Date of Patent: Mar. 19, 1991

[54] VARIABLE SKEW FAN

[75] Inventors: Robert J. Van Houten, Winchester; David Daiute, Ashland, both of Mass.

[73] Assignee: Airflow Research and Manufacturing Corporation, Watertown, Mass.

[21] Appl. No.: 392,769

[22] Filed: Aug. 11, 1989

[51] Int. Cl.[5] ..... F04D 29/66

[52] U.S. Cl. ..... 416/203; 416/175; 415/119

[58] Field of Search ..... 416/203, 175, 189 R, 416/238, 195, 169 A, DIG. 2, 228; 415/119

[56] References Cited

U.S. PATENT DOCUMENTS

| | | | |
|---|---|---|---|
| D. 262,791 | 1/1982 | Piarulli et al. | 8/480 |
| 268,292 | 11/1882 | Robinson | 416/175 |
| 332,309 | 12/1885 | Vogelsang | 416/203 |
| 360,833 | 4/1887 | Vogelsang | 416/203 |
| 1,868,008 | 7/1932 | Gardner | 416/203 |
| 1,893,184 | 1/1933 | Smellie | 416/188 |
| 1,983,606 | 12/1934 | Geise | 165/122 |
| 2,097,205 | 10/1937 | Cary | 416/203 |
| 2,098,640 | 11/1937 | Cary | 416/203 |
| 2,238,749 | 4/1941 | Peltier | 416/203 |
| 2,269,049 | 1/1942 | Zellweger | 416/175 |
| 2,426,270 | 8/1947 | Howell | 416/203 X |
| 2,916,258 | 12/1959 | Klint | 416/203 |
| 3,006,603 | 10/1961 | Caruso et al. | 416/203 X |
| 3,315,749 | 4/1967 | Parsons et al. | 416/203 |
| 3,356,154 | 12/1967 | Cassidy | 416/203 |
| 3,398,866 | 8/1968 | La Flame et al. | 222/333 |
| 3,426,535 | 2/1969 | Mlacker et al. | 60/54 |
| 3,536,417 | 10/1970 | Stiefel et al. | 416/203 X |
| 3,764,225 | 10/1973 | Dzung | 415/193 |
| 4,253,800 | 3/1981 | Segawa et al. | 416/203 |
| 4,306,839 | 12/1981 | Pien | 416/200 |
| 4,514,146 | 4/1985 | Nojiri et al. | 416/200 |
| 4,538,963 | 9/1985 | Sugio et al. | 416/203 |
| 4,543,041 | 9/1985 | French et al. | 416/183 |
| 4,548,548 | 10/1985 | Gray | 416/189 R |
| 4,569,631 | 2/1986 | Gray | 416/189 R |
| 4,569,632 | 2/1986 | Gray | 416/189 R |
| 4,684,324 | 8/1987 | Perosino | 416/189 R |
| 4,685,513 | 8/1987 | Longhouse et al. | 416/189 X |
| 4,729,714 | 3/1988 | Wrobel | 416/203 X |
| 4,863,351 | 9/1989 | Fischer et al. | 416/203 |

FOREIGN PATENT DOCUMENTS

| | | | |
|---|---|---|---|
| 568402 | 1/1933 | Fed. Rep. of Germany . | |
| 2524555 | 12/1975 | Fed. Rep. of Germany . | |
| 1012041 | 7/1952 | France . | |
| 957393 | 5/1964 | United Kingdom | 416/203 |
| 1293553 | 10/1972 | United Kingdom . | |
| 1523884 | 9/1978 | United Kingdom . | |

*Primary Examiner*—John T. Kwon

[57] ABSTRACT

An axial flow fan comprising: a cental hub rotatable on an axis; and a plurality of blades extending from the hub, each of the blades comprising a root portion adjacent to the hub, and terminating in a tip portion, the root portions of the blades being approximately evenly spaced around the hub; wherein each of the blades exhibits a curvature from the root portion of the blade to the blade's tip portion, the curvature being in a plane that is perpendicular to the axis on which the fan rotates; and wherein the curvature differs between at least two of the blades, such that the distance between the tip portions of at least wo sets of adjacent blades is unequal. The invention therefore achieves the advantage of having uneven blade spacing near the tips while maintaining high solidity near the hub, where the blade spacing is even. Uneven blade spacing near the tips reduces noise. Having high solidity near the hub, where non-dimensional loading is highest, maintains higher dynamic performance.

8 Claims, 2 Drawing Sheets

VARIABLE SKEW FAN

BACKGROUND OF THE INVENTION

This invention relates generally to fans having several blades used to move a fluid such as air. In particular, the invention features a fan having blades with variable skew. (i.e., the blade skew varies between at least two of the fan blades.)

Fans are typically constructed with identical blades that are attached at a common hub, the hub being rotated by, e.g., an electric motor through a shaft attached to the hub. The blades are usually evenly spaced around the periphery of the hub. When the inflow velocity of air entering a fan varies (especially circumferential variations), the fan will often generate audible tones at frequencies corresponding to the blade passing frequency (i.e., the frequency at which the blades pass a fixed point) and multiples of the blade passing frequency.

In order to reduce the magnitude of these tones, fans have been constructed with blades located at uneven intervals around the periphery of the hub. (See, e.g., U.S. Pat. No. 3,315,749 to K. W. Parsons et al.) When the blades are unevenly spaced, tones are generated at the same frequency as the frequency at which the shaft rotates, and at multiples of that frequency. Since the shaft rotation frequency is much less than the blade passing frequency, the total number of tones generated within any frequency band is much greater than in the case of evenly spaced blades, and the strength of each tone is correspondingly reduced. If reduced sufficiently, these tones can become inaudible due to the masking effect of various broadband noise sources, including the fan itself. A further advantage of having blades that are unevenly spaced is that the frequency of the lowest frequency tones produced is in a frequency range where the human ear is relatively insensitive. In this way fan noise can be made less objectionable.

SUMMARY OF THE INVENTION

The invention generally features an axial flow fan that achieves the advantages of having the blades unevenly spaced without sacrificing performance as do previous fans that employ uneven blade spacing. The fan of the invention, unlike previous fans, uses blades that are essentially evenly spaced near the hub, but have variable spacing near the tip sections of the blades, to reduce audible tones. Since the noise produced by the sections of the fan blades near the hub is negligible compared to the noise produced by the tip sections of the blades, the advantages of uneven blade spacing are realized by having only the tip sections of the blades unevenly spaced. This is achieved by varying the "skew" of at least two of the blades. Skew is defined as the angle between the midpoint of the blade root and the midpoint of the blade tip, and is explained in greater detail below.

The fan of the invention generally comprises: a central hub rotatable on an axis; and a plurality of blades extending from the hub, each of the blades comprising a root portion adjacent to the hub, and terminating in a tip portion, the root portions of the blades being approximately evenly spaced around the hub; wherein each of the blades exhibits a curvature from the root portion of the blade to the blade's tip portion, the curvature being in a plane that is perpendicular to the axis on which the fan rotates; and wherein the curvature differs between at least two of the blades, such that the distance between the tip portions of at least two sets of adjacent blades is unequal.

In one preferred embodiment, the blades are "back-skewed" (i.e., skewed in a direction opposite to the direction of rotation of the fan), and each of the blades is skewed by a different amount. In another preferred embodiment, the fan includes at least two identical groups of blades. The distance between the blade tips of at least two sets of adjacent blades varies by at least a factor of 1.5. The blade tips are connected by a band.

DETAILED DESCRIPTION OF THE PREFERRED EMBODIMENTS

Drawings

Structure and Operation

Figure 1:
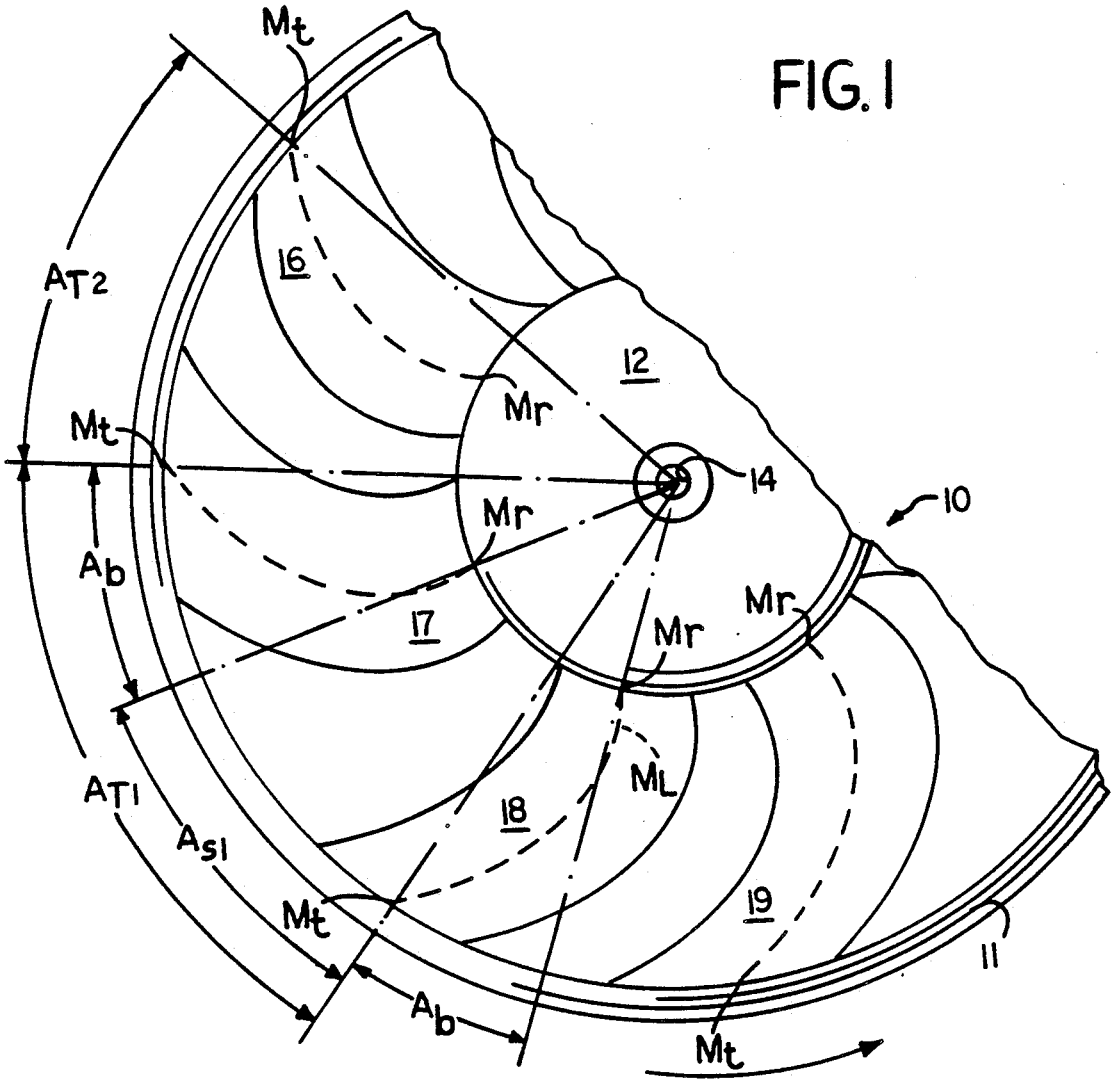
FIG. 1 is a plan view of a fan according to the invention.

Referring to FIG. 1, a fan 10 has a cylindrical hub section 12 for housing a motor (not shown). The motor shaft is attached to the hub at aperture 14 and thus rotates the fan. A plurality of blades, blades 16–19 being shown as illustrative, extend radially outward from hub 12 to their respective tips, where they are joined to band 11.

The fan blades have different shapes, with each of the blades having a different "blade skew." The blade skew is defined as the angle $A_b$ between the midpoint ($M_r$) of the blade root and the midpoint ($M_t$) of the blade tip. As can be seen in FIG. 1, the skew angle $A_b$ is substantially greater for blade 17 than for blade 18. However, all blades are approximately evenly spaced at the hub so that the distance between the midpoints $M_r$ of each blade root in fan 10 is approximately equal. Since the blades have a variable skew as described above, the distance between the tips of the blades will vary. i.e., the distance between the midpoints $M_t$ will vary, achieving the advantages of reduced noise described above. Since the blades are evenly spaced at the hub, however, the hub will have a high solidity resulting in superior aerodynamic performance, as explained in detail below.

A disadvantage of having uneven blade spacing is that the aerodynamic performance can be degraded, particularly for the sections of the blades near the hub, which work at a higher "non-dimensional loading" than the sections of the blades near the tips of the blades. Non-dimensional loading is the ratio of the change of pressure across the fan to the product of the density of the fluid moved by the fan and the square of the speed of the fan blades. Since non-dimensional loading is inversely proportional to the square of the blade speed, and because the speed of the tips of the blades is greater than the speed of the sections of the blades near the hub, fans are more heavily loaded near the hub, and therefore require a higher solidity near the hub than near the tip sections. This solidity is often limited by the requirement that the fan be injection moldable (i.e., the blades cannot overlap). If the root sections of the blades are unevenly spaced, the requirement that the blades not overlap will further limit blade design in the areas where the blades are close together. In those areas where the blades are spread further apart, high solidity will be achievable only by increasing blade chords, which in turn will increase the projected width of the fan. In applications such as automotive cooling systems, where the fan must be compact, this increase in fan width is often not acceptable, so the solidity at the blade root will be made smaller than aerodynamic considerations deem desirable. As explained above, however, the present invention uses blades with varied skew to achieve the advantage of varied spacing at the tips of the blades, while maintaining even spacing near the hub, resulting in high solidity near the hub.

Figure 2:
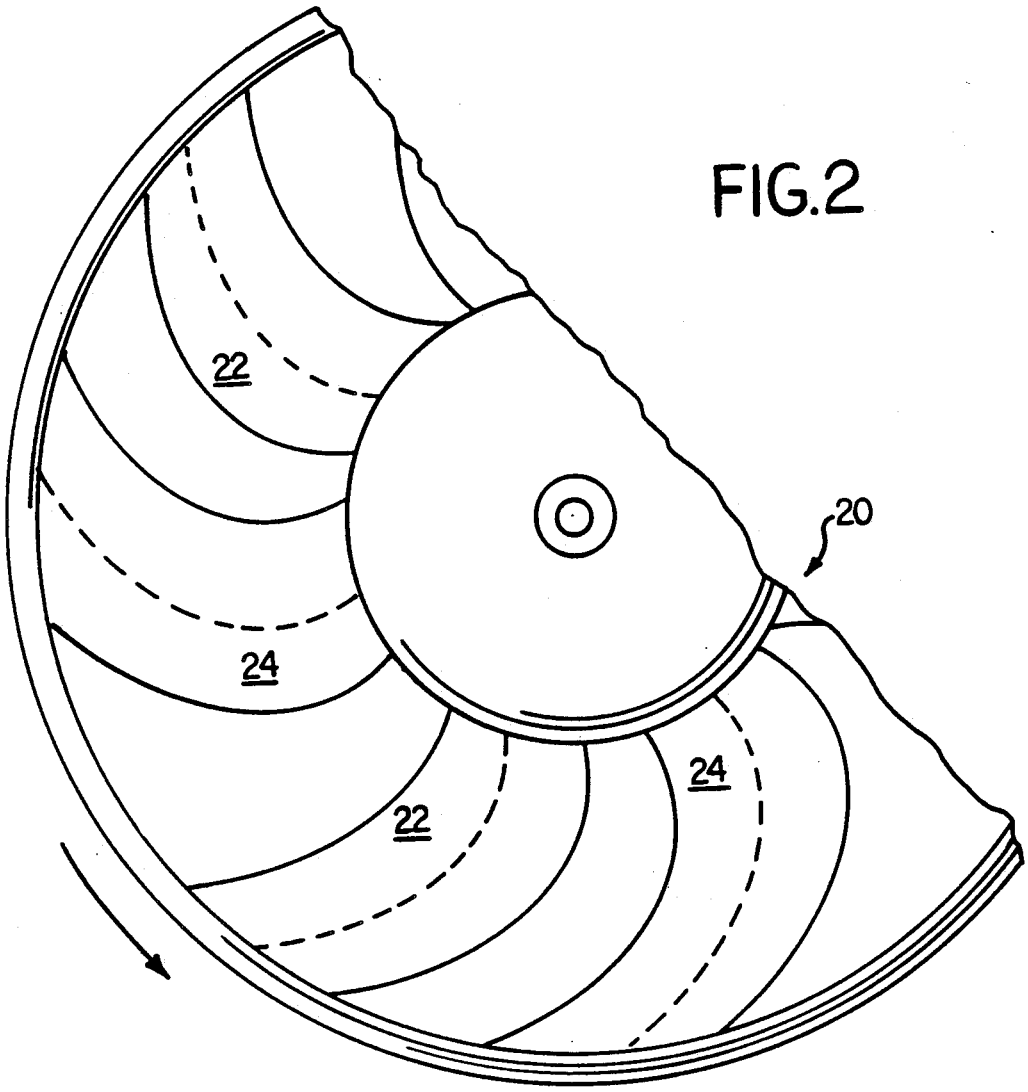
FIG. 2 is a plan view of a second embodiment of the invention.

As described above, the preferred embodiment is a fan with blades whose skew distribution varies from blade to blade. However, two or more identical groups of blades may be used, each of which would contain at least two blades. Referring to FIG. 2, a fan 20 is shown that comprises two identical blades 22 and two identical blades 24, forming at least two identical groups of blades (i.e., each group includes one blade 22 and one blade 24). The use of identical groups makes it easier to design a fan that is both dynamically and statically balanced. Using identical groups of blades also reduces the number of different blade designs.

The preferred embodiments are merely illustrative and other embodiments are within the scope of the appended claims.

We claim:

1. An axial flow fan comprising:

a central hub rotatable on an axis; and a plurality of blades extending from said hub, each of said blades comprising a root portion adjacent said hub, and terminating in a tip portion, said root portions being approximately evenly spaced around said hub;

wherein each of said blades exhibits a curvature from said root portion to said tip portion, said curvature being in a plane that is perpendicular to said axis; and wherein said curvature differs between at least two of said blades, such that the distance between the midpoint of said tip portions of at least two sets of adjacent blades is unequal.

2. The fan of claim 1 wherein said blades are back-skewed.

3. The fan of claim 1 comprising at least two identical groups of blades.

4. The fan of claim 1 wherein the distance between said blade tips of said at least two sets of adjacent blades varies by at least a factor of 1.5.

5. The fan of claim 1 where said blade tips are connected by a band.

6. The fan of claim 1 wherein the distance between the corresponding leading edges and the corresponding trailing edges of at least two sets of adjacent blades is unequal.

7. The fan of claim 1 wherein at least two of said blades have approximately the same chord length.

8. The fan of claim 7 wherein each of said blades has approximately the same chord length.

* * * * *